US007496316B2

(12) United States Patent
Ito et al.

(10) Patent No.: US 7,496,316 B2
(45) Date of Patent: Feb. 24, 2009

(54) IMAGE FORMING APPARATUS INCLUDING AN OPENABLE SECTION AND SEPARATING MECHANISM WITH CAM

(75) Inventors: Hiroshi Ito, Osaka (JP); Chisato Hatakeyama, Osaka (JP); Kunihiko Ishii, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 459 days.

(21) Appl. No.: 11/337,668

(22) Filed: Jan. 24, 2006

(65) Prior Publication Data

US 2006/0165437 A1 Jul. 27, 2006

(30) Foreign Application Priority Data

Jan. 25, 2005 (JP) ..... 2005-016342

(51) Int. Cl.
*G03G 15/20* (2006.01)

(52) U.S. Cl. ..... 399/122

(58) Field of Classification Search ..... 399/122, 399/124, 322, 331; 219/216
See application file for complete search history.

(56) References Cited

U.S. PATENT DOCUMENTS 4,384,781 A * 5/1983 Takada ..... 399/122
4,421,401 A * 12/1983 Kagiura et al. ..... 399/122
4,475,804 A * 10/1984 Kanno et al. ..... 399/323
4,571,056 A * 2/1986 Tani et al. ..... 399/122
4,782,359 A * 11/1988 Tomoe ..... 399/122
5,045,887 A * 9/1991 Nakamura ..... 399/122
6,078,765 A 6/2000 Takano et al.
6,757,502 B2 * 6/2004 Yoshikawa ..... 399/22

FOREIGN PATENT DOCUMENTS

| | | | |
|---|---|---|---|
| CN | 1215852 A | | 5/1999 |
| JP | 02029678 A | * | 1/1990 |
| JP | 4-52676 | | 2/1992 |
| JP | 06004000 A | * | 1/1994 |
| JP | 11-125985 | | 5/1999 |
| JP | 2000-019885 | | 1/2000 |

* cited by examiner

*Primary Examiner*—Robert Beatty
(74) *Attorney, Agent, or Firm*—Smith, Gambrell & Russell, LLP

(57) ABSTRACT

A pair of fixing section discharge rollers 24 is arranged on the downstream side, with respect to the paper conveying direction, of a fixing section 20 including a fixing roller 21 and a pressing roller 22. Near the fixing section 20, a openable section 40 is provided that makes externally accessible the paper conveying passage on the downstream side of the fixing section 20. The openable section 40 has the axis of its pivot portion 41 aligned with the axis of the pressing roller 22, and is rotatable about the pivot portion 41. The fixing section discharge rollers 24 are mounted on the openable section 40. If a paper jam occurs on the downstream side of the fixing section 20, when the openable section 40 is opened, a wide space is secured on the downstream side of the fixing section 20, and the paper P stuck in the conveying nip between the fixing section discharge rollers 24 is automatically brought outward.

5 Claims, 4 Drawing Sheets

IMAGE FORMING APPARATUS INCLUDING AN OPENABLE SECTION AND SEPARATING MECHANISM WITH CAM

This application is based on Japanese Patent Application No. 2005-016342 filed on Jan. 25, 2005, the contents of which are hereby incorporated by reference.

BACKGROUND OF THE INVENTION

1. Field of the Invention

The present invention relates to an image forming apparatus as exemplified by a copier and a printer.

2. Description of Related Art

An electrophotographic image forming apparatus such as a copier or a printer incorporates a fixing section, where it fixes a toner image on paper by applying heat and pressure to the paper having the toner image transferred thereto. Heat is applied to the paper by the use of a fixing member such as a fixing roller or a fixing belt. This fixing member is kept in pressed contact with a pressing member such as a pressing roller or a pressing belt so that a fixing nip is formed in between through which to pass the paper to apply pressure thereto.

In the fixing section of the image forming apparatus described above, the contact between the fixing member and the paper is so intimate that the paper may fail to come off the fixing member. If the paper fails to come off the fixing member, it may jam around the exit of the fixing section and be exposed to a high temperature. To avoid this, a peel-off claw is commonly provided at the exit of the fixing section so that the paper is forcibly taken off the fixing member. Such a peel-off claw is effective in taking the paper off the fixing member, indeed, but, once the paper jams, the peel-off claw may become an obstacle that interferes with jam disposal. This inconvenience has led to the proposal of a construction that can cope with a paper jam when one occurs in the fixing section. Such a construction is proposed, for example, in Japanese Patent Application Laid-open No. 2000-19885 (hereinafter referred to as Patent Publication 1).

In the fixing unit disclosed in Patent Publication 1, a peel-off claw for taking paper off a heating roller (fixing member) is provided near the exit of a fixing section, and, when a paper jam ever occurs, the peel-off claw is retracted to a position where it does not interfere with jam disposal. Here, inconveniently, just on the downstream side of the fixing member and a pressing member, a paper discharge roller (fixing section discharge roller) is provided, and, even if the peel-off claw is retracted, the paper discharge roller can not. Thus, the paper discharge roller may interfere with jam disposal. This situation cannot be coped with by the user, causing great inconvenience to the user.

SUMMARY OF THE INVENTION

In view of the conventionally encountered inconveniences mentioned above, it is an object of the present invention to provide an image forming apparatus that has the exit part of the fixing section thereof compactly constructed and that permits easy and safe jam disposal free from interference by another member disposed on the downstream side of a fixing member and a pressing member.

To achieve the above object, according to the present invention, an image forming apparatus is provided with: a fixing section including a fixing member and a pressing member each built as a rotary member; a pair of fixing section discharge rollers, disposed on the downstream side of the fixing section with respect to the paper conveying direction, for discharging paper out of the fixing section and further downstream; and an openable section having the pair of fixing section discharge rollers mounted thereon, the openable section being rotatable about a pivot portion thereof parallel to the axis of the fixing or pressing member so as to make externally accessible the paper conveying passage on the downstream side of the fixing section with respect to the paper conveying direction.

With this construction, as the openable section is opened, the pair of fixing section discharge rollers can be moved into an open position. Thus, if jamming paper is stuck in the conveying nip between the fixing section discharge rollers, it can automatically be taken out. This eliminates the need for a human to hold the paper in hand and pull it out, saving the trouble and time to do so, and permitting the paper to be easily moved away from the hot fixing member. Even if the paper is wound around the fixing member, it can be easily disposed of. Since the pair of fixing section discharge rollers can be moved into an open position, a wide space can be secured on the downstream side of the fixing section. This makes jam disposal easy. In this way, it is possible to construct the exit part of the fixing section compactly, and simultaneously to make easy and safe jam disposal possible without interference by another member disposed on the downstream side of the fixing and pressing members.

According to the present invention, the image forming apparatus constructed as described above may be further provided with a separating mechanism for releasing the fixing nip formed as a result of the fixing and pressing members being brought into pressed contact with each other. In this case, the separating mechanism brings the fixing and pressing members apart from each other in a coordinated manner as the openable section is opened.

With this construction, when a paper jam occurs with the paper stuck in the fixing nip, the nip can be released so that the paper can be taken out easily. Thus, when a paper jam occurs in the fixing section, jam disposal can be performed more easily and safely.

According to the present invention, in the image forming apparatus constructed as described above, the separating mechanism may be built as a cam mechanism that brings the fixing and pressing members apart from each other in a coordinated manner as the openable section is opened.

With this construction, as the openable section is rotated, the fixing and pressing members can automatically be moved apart from each other. Thus, without the need for a complicate mechanism or electrical circuitry, and hence with a compact, simple construction, it is possible to facilitate jam disposal in the fixing section.

According to the present invention, in the image forming apparatus constructed as described above, the axis of rotation of a cam included in the cam mechanism may be aligned with the axis of the pressing member.

With this construction, the space occupied by the cam can be reduced, and thus space saving can be achieved in the openable section. This reduces restrictions in design, and permits the part around the fixing section to be made more compact. Moreover, with the resulting simpler mechanism, it is possible to move the fixing and pressing members apart from each other with a weak force.

According to the present invention, in the image forming apparatus constructed as described above, the openable section may have a double-side-copying paper conveying passage formed on the face thereof facing away from the fixing section.

With this construction, in an image forming apparatus capable of double-side printing, there is no need to provide an extra member to form a double-side-copying paper conveying passage. This helps reduce the number of components, and helps achieve space saving and cost reduction.

According to the present invention, in the image forming apparatus constructed as described above, the openable section has a pair of paper conveying rollers disposed on the downstream side of the fixing section discharge rollers with respect to the paper conveying direction.

With this structure, as the openable section is opened, the paper conveying rollers can be moved into an open position. Thus, if jamming paper is stuck in the conveying nip between the paper conveying rollers, it can automatically be taken out. Thus, even when a paper jam occurs further downstream of the pair of fixing section discharge rollers, it is possible to dispose of the paper jam easily and safely without taking trouble and time.

DETAILED DESCRIPTION OF PREFERRED EMBODIMENTS

Hereinafter, an embodiment of the present invention will be described with reference to FIGS. 1 to 4.

Figure 1:
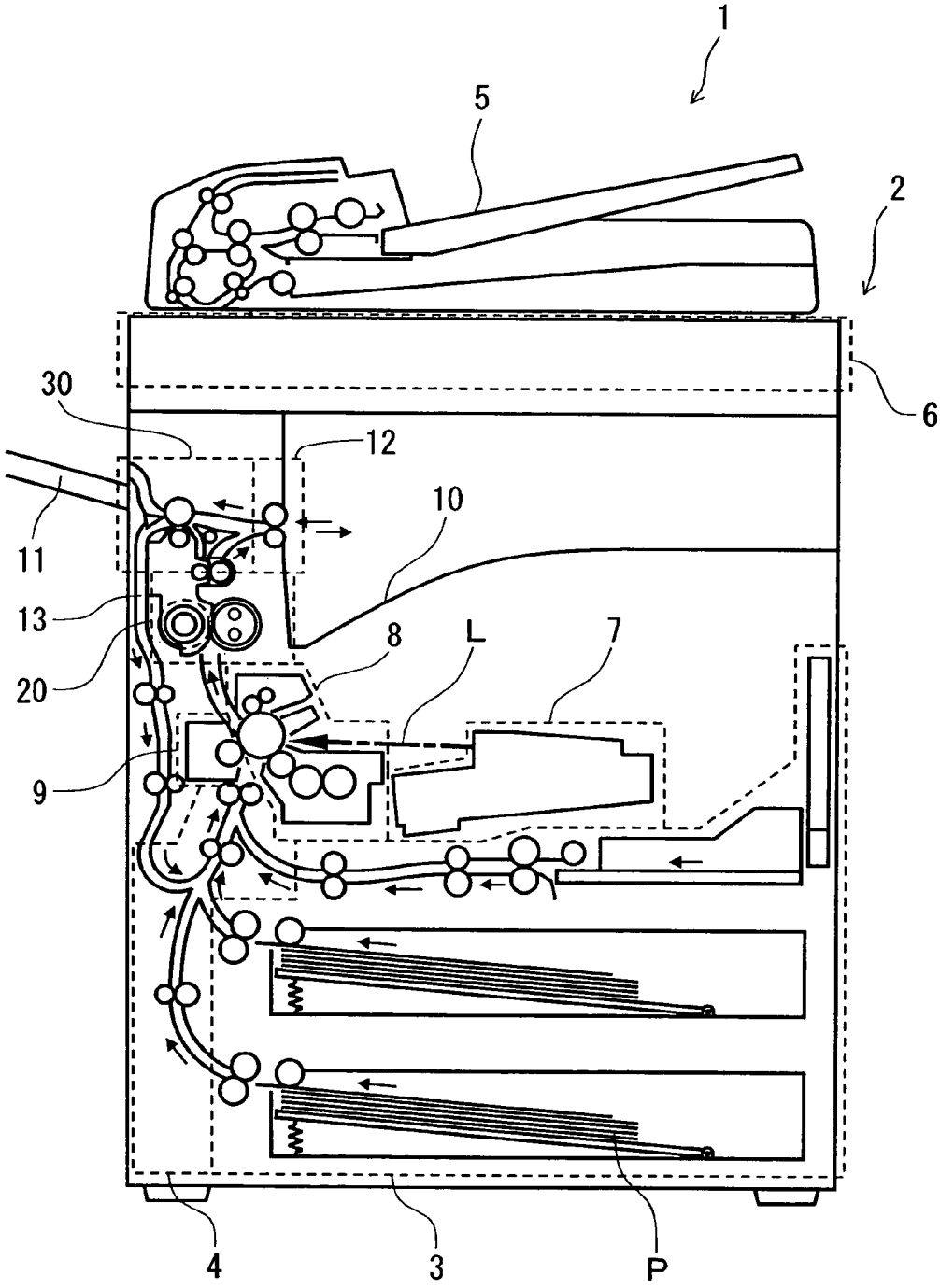
FIG. 1 is a schematic vertical sectional view, as seen from the front, of an image forming apparatus embodying the present invention.

First, an outline of the construction of an image forming apparatus embodying the present invention, along with the image output operation it performs, will be described with reference to FIG. 1. FIG. 1 is a schematic vertical sectional view, as seen from the front, of the image forming apparatus. In the figure, solid-line arrows indicate the passage through which and the direction in which paper is conveyed, and a dash-and-dot-line arrow represents a laser beam L.

As shown in FIG. 1, in a lower portion of a body 2 of the image forming apparatus 1, a paper feed section 3 is arranged. Inside the paper feed section 3, unprinted paper P, in the form of stacks of cut sheets, is stocked. From the paper feed section 3, the paper P is fed out one sheet after another.

Inside the body 2, in a portion thereof on the left of the paper feed section 3, a paper conveying section 4 is provided. The paper P fed out from the paper feed section 3 is conveyed by the paper conveying section 4 in a direction vertically upward along a side face of the body 2 to reach a transfer section 9, which will be described later.

At the top face of the image forming apparatus 1, a document feed section 5 is provided, and, under the document feed section 5, a document image scanning section 6 is provided. When a user wants to make a copy of a document, he or she places it on the document feed section 5. The document has images on it that include, for example, characters, figures, and patterns. The document feed section 5 feeds out the document one sheet after another, and the document image scanning section 6 reads the images on it to acquire image data. The image data is fed to a laser irradiation section 7 arranged in a central portion of the body 2. The laser irradiation section 7 irradiates an image forming section 8, which will be described later, with a laser beam L controlled according to the image data.

Above the paper conveying section 4, on the left of the laser irradiation section 7, the image forming section 8 and the transfer section 9 are provided. The image forming section 8, by using the laser beam L shone from the laser irradiation section 7, forms an electrostatic latent image of a document image. According to the latent image, a toner image is formed. The toner image is transferred by the transfer section 9 onto the unprinted paper P that has been conveyed synchronously by the paper conveying section 4.

Above the transfer section 9, a fixing section 20 is provided. The paper P, having the unfixed toner image transferred thereon by the transfer section 9, is conveyed to the fixing section 20, where heat and pressure are applied to the toner image with a fixing roller and a pressing roller so that the toner image is fixed.

Above the fixing section 20, a branch section 30 is provided. Unless double-side printing is performed, the paper P discharged from the fixing section 20 is sorted by the branch section 30 so as to be ejected either into an in-body ejected paper tray 10 provided inside the body of the image forming apparatus 1 or into an external ejected paper tray 11 provided outside.

The ejection opening through which the paper P is ejected from the branch section 30 toward the in-body ejected paper tray 10 functions as a switchback section 12. When double-side printing is performed, the switchback section 12 reverses the conveying direction of the paper P ejected from the fixing section 20. The paper P is then conveyed downward through a double-side-printing paper conveying passage 13 provided on the left of the fixing section 20 and the transfer section 9 so as to be conveyed again through the paper conveying section 4 to the transfer section 9.

Figure 2:
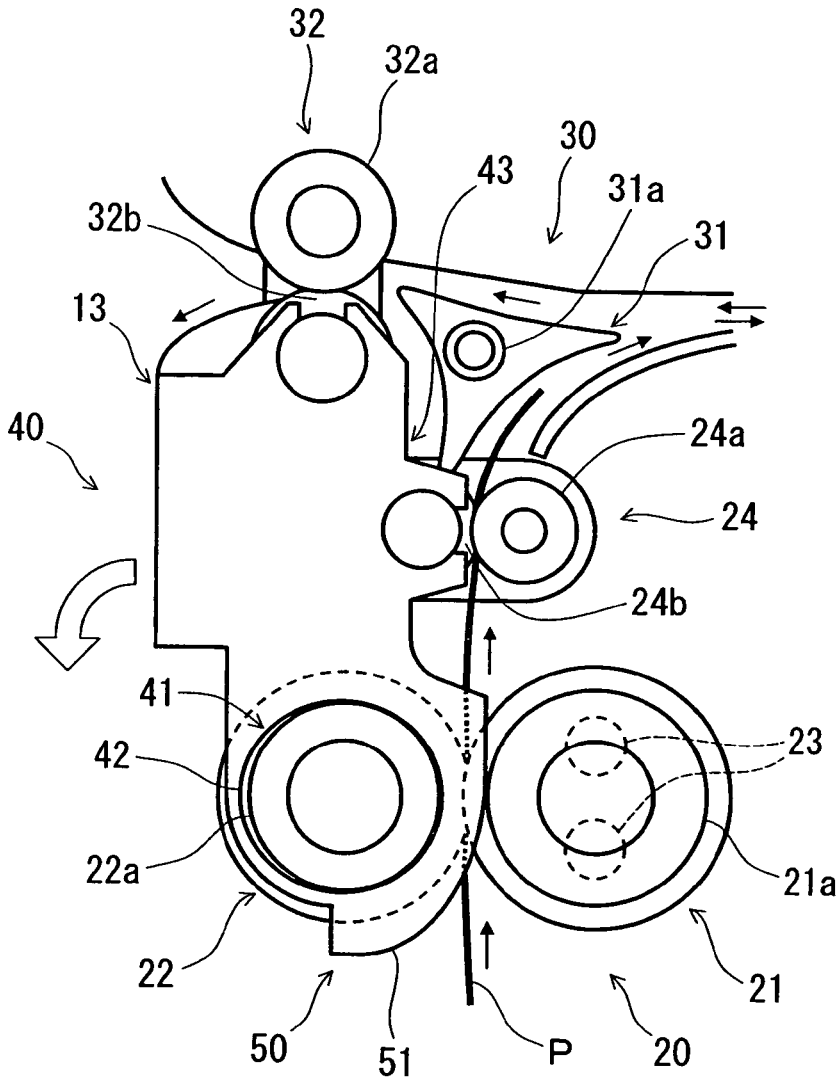
FIG. 2 is an enlarged view, as seen from the front, of part of the vertical section of the image forming apparatus shown in FIG. 1, showing part around the fixing section.
Figure 3:
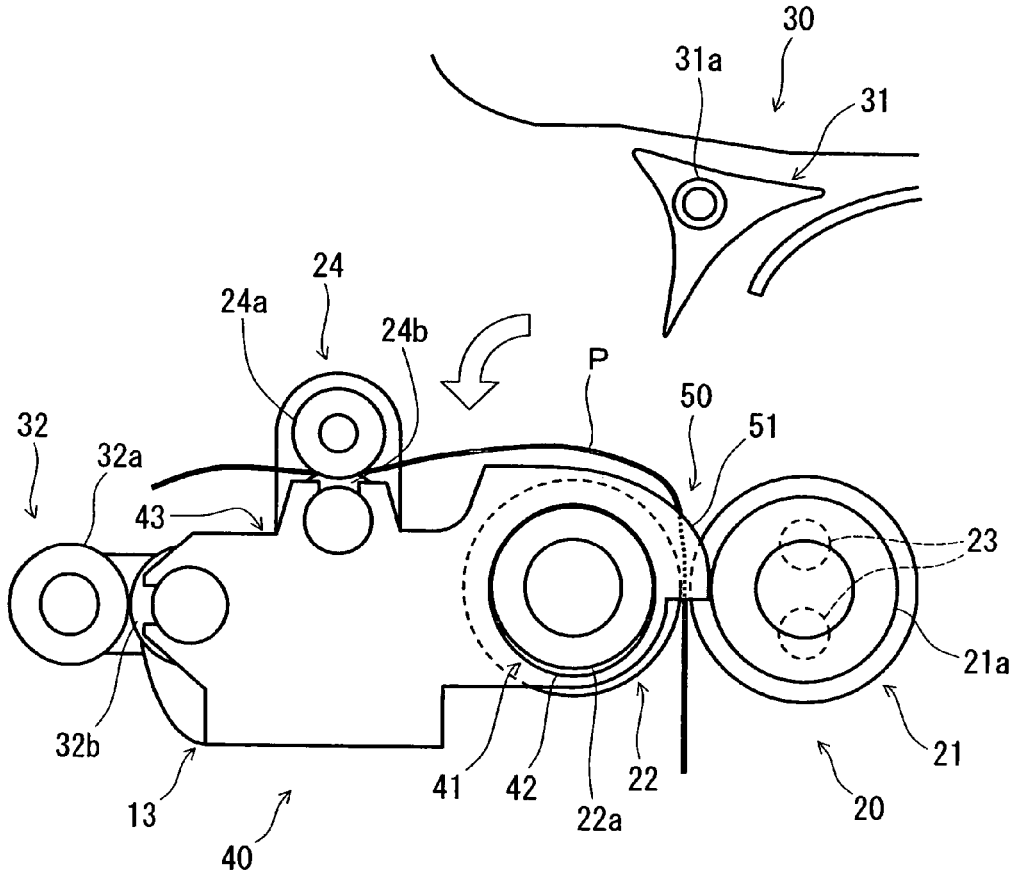
FIG. 3 is an enlarged view, as seen from the front, of part of the vertical section, showing the openable section in its open position.
Figure 4:
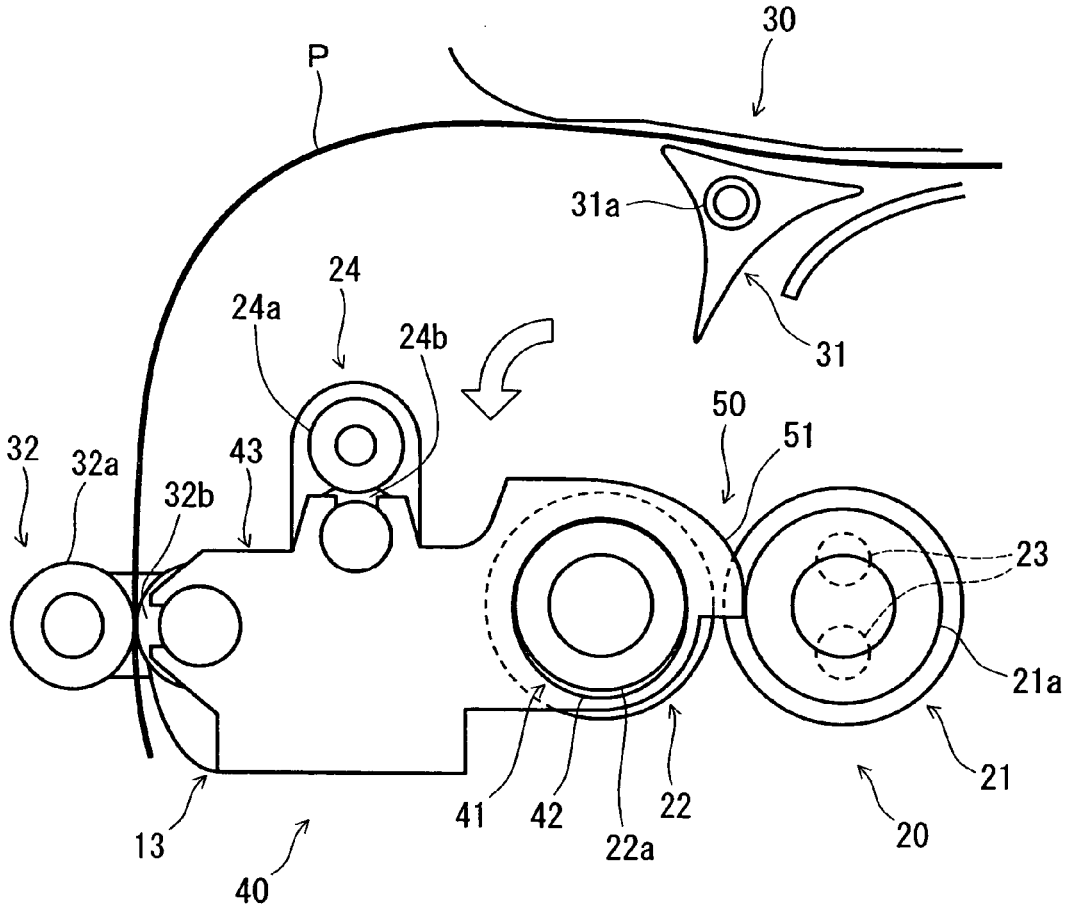
FIG. 4 is an enlarged view, as seen from the front, of part of the vertical section, showing a case where a paper jam has occurred at a location different from where one has occurred in FIG. 3.

Next, the construction of the image forming apparatus 1 around the fixing section 20 will be described in detail with reference to, in addition to FIG. 1, FIGS. 2 to 4. FIG. 2 is an enlarged view, as seen from the front, of part of the vertical section of the image forming apparatus 1, showing part around the fixing section. FIG. 3 is, like FIG. 2, an enlarged view, as seen from the front, of part of the vertical section, showing an openable section in its open position. FIG. 4 is, like FIG. 3, an enlarged view, as seen from the front, of part of the vertical section, showing a case where a paper jam has occurred at a location different from where one has occurred in FIG. 3. In FIGS. 2 to 4, a thick solid line represents paper P, solid-line arrows indicate the passage through which and the direction in which the paper P is conveyed, and a hollow arrow indicates the direction in which the openable section opens.

As shown in FIG. 2, the fixing section 20 is provided with a fixing roller 21 as a fixing member and a pressing roller 22 as a pressing member.

The fixing roller 21 has a diameter of 40 mm, and has silicone rubber, which forms an elastic material layer, laid on the surface of a core member such as an aluminum tube. In intimate contact with the surface of the elastic material layer, a toner-releasing layer formed of fluorine resin is laid for higher surface smoothness and toner releasability. At each end of the fixing roller 21, a shoulder portion 21*a* is provided that is in the shape of a circular column or tube coaxial with the fixing roller 21 and that protrudes outward along the axis thereof. Inside the fixing roller 21, a halogen lamp 23 is arranged as a heat source.

The pressing roller 22 has silicone sponge rubber, which forms an elastic material layer, laid on the outer surface of a metal core formed of aluminum. As with the fixing roller 21, also at each end of the pressing roller 22, a shoulder portion 22*a* is provided that is in the shape of a circular column or tube coaxial with the pressing roller 22 and that protrudes outward along the axis thereof.

The fixing section 20 is provided with a pressing mechanism (unillustrated) that presses the pressing roller 22 onto the fixing roller 21. The pressing mechanism keeps the fixing and pressing rollers 21 and 22 in pressed contact with each other at a predetermined pressure to form a fixing nip having a predetermined dimension in the paper conveying direction. Through the fixing nip, the paper P having the unfixed toner image transferred thereon passes. The fixing roller 21 is rotated by an unillustrated drive mechanism at the same peripheral speed at which the paper is conveyed. Since the fixing section 20 is kept in contact with the fixing roller 21, as the fixing roller 21 rotates, the fixing section 20 rotates together. In ordinary fixing operation, while the paper P is conveyed from bottom to top as seen in FIGS. 1 and 2, the fixing roller 21 rotates clockwise and the pressing roller 22 counter-clockwise to fix the unfixed toner image on the surface of the paper P.

On the downstream side, with respect to the paper conveying direction, of the fixing section 20 provided with the fixing and pressing rollers 21 and 22 as described above, a pair of fixing section discharge rollers 24 is arranged. The fixing section discharge rollers 24 are paired rollers composed of a drive roller 24*a* and a driven roller 24*b*. These rollers are kept in pressed contact with each other at a predetermined pressure to form a conveying nip having a predetermined dimension in the paper conveying direction. The fixing section discharge rollers 24 convey the paper P out of the fixing section 20 and further downstream to the branch section 30.

As shown in FIG. 2, the branch section 30, which is located above the fixing section 20, is provided with a movable guide 31. The movable guide 31 has approximately the same width as the paper conveying passage in the paper width direction, which is perpendicular to the paper conveying direction. For easy sorting of the paper P, the movable guide 31 has the front face thereof, which is perpendicular to the paper conveying direction, formed in the shape of a wedge. The movable guide 31 is provided with a shaft portion 31*a* extending in the paper width direction, and is supported by the shaft portion 31*a* on the body 2 so as to be rotatable with respect thereto. The movable guide 31, by rotating in a vertical plane about the shaft portion 31*a*, can move between a position in which it leads the paper P into the in-body ejected paper tray 10 (see FIG. 1) and a position in which it leads the paper P into the external ejected paper tray 11 (see FIG. 1).

On the downstream side, with respect to the paper conveying direction, of the movable guide 31, in the direction of the external ejected paper tray 11, a pair of conveying rollers 32 is arranged as paper conveying rollers. The conveying rollers 32 are, like the fixing section discharge rollers 24, paired rollers composed of a drive roller 32*a* and a driven roller 32*b*. These rollers are kept in pressed contact with each other at a predetermined pressure to form a conveying nip having a predetermined dimension in the paper conveying direction. The conveying rollers 32 conveys the paper P out to the external ejected paper tray 11, or alternatively, when double-side printing is performed, downward to the paper conveying section 4 (see FIG. 1).

Where the fixing section 20 and the branch section 30 as described above are located, an openable section 40 is provided. The openable section 40 has approximately the same dimension as the pressing roller 22 in the paper width direction. The openable section 40 is provided with a pivot portion 41, which has a circular opening 42 formed therein. The circular opening 42 is so large as to accommodate the shoulder portion 22*a* provided at each end of the pressing roller 22, and the shoulder portion 22*a* penetrates the pivot portion 41 through the circular opening 42. Thus, the axis of the pivot portion 41 of the openable section 40 is aligned with the axis of the pressing roller 22, and the openable section 40 is rotatably supported by the pivot portion 41. As the openable section 40 rotates in a vertical plane about the pivot portion 41, the paper conveying passage on the downstream side of the fixing section 20 becomes externally accessible as shown in FIG. 3. An inner wall portion 43 of the openable section 40 forms the openable section 40 side face of the paper conveying passage on the downstream side of the fixing section 20. The openable section 40 is further provided with a double-side-printing paper conveying passage 13 on the face thereof facing away from the inner wall portion 43, that is, facing away from the face where the fixing section 20 is provided.

The fixing section discharge rollers 24, and also the conveying rollers 32 located on the downstream thereof, are mounted on the openable section 40. Thus, as the openable section 40 is opened and closed, the fixing section discharge rollers 24 and the conveying rollers 32 move together therewith between an open and a closed position.

Near the pivot portion 41 of the openable section 40, a separating mechanism 50 is provided. The separating mechanism 50 is provided with a cam portion 51. The rotation axis of the cam portion 51 is aligned with the axis of the pressing roller 22. The edge surface of the cam portion 51 is kept in contact with the circumferential surface of the shoulder portion 21*a* provided at each end of the fixing roller 21. The cam portion 51 is so shaped that, as the openable section 40 is opened, the cam portion 51 brings the pressing roller 22, which is engaged with the pivot portion 41 of the openable section 40, apart from fixing roller 21 against the pressing mechanism that is pressing the pressing roller 22 onto the fixing roller 21. Built as a cam mechanism as described above, the separating mechanism 50 can release the fixing nip formed by the fixing and pressing rollers 21 and 22 being kept in pressed contact with each other.

With the fixing section 20 and the part around it constructed as described above, when ordinary image forming operation is performed, the paper P that has passed through the fixing section 20 is delivered by the fixing section discharge rollers 24 to the branch section 30 as shown in FIG. 2. If a paper jam occurs here, when the openable section 40 is opened as shown in FIG. 3, a wide space is secured on the downstream side of the fixing section 20, and the paper P stuck in the conveying nip between the fixing section discharge rollers 24 is automatically brought outward. Here, in a coordinated manner as the openable section 40 is opened, the separating mechanism 50 acts on the fixing and pressing rollers 21 and 22 so as to bring the pressing roller 22 apart from the fixing roller 21 against the pressing mechanism that is pressing the pressing roller 22 onto the fixing roller 21. Thus, the fixing and pressing rollers 21 and 22 are brought apart from each other, and the fixing nip is released (see FIG. 3).

On the other hand, if a paper jam occurs when the paper P is being conveyed by the conveying rollers 32, when the openable section 40 is opened, the paper P stuck in the conveying nip between the conveying rollers 32 is automatically brought outward.

As described above, the openable section 40 is provided to make externally accessible the paper conveying passage on the downstream side of the fixing section 20 with respect to the paper conveying direction. Moreover, the openable section 40 is rotatable about the pivot portion 41 parallel to the axis of the pressing roller 22, and is provided with the fixing section discharge rollers 24 that convey the paper P out of the fixing section 20 and further downward. Thus, as the openable section 40 is opened, the fixing section discharge rollers 24 can be moved into an open position, and the paper P stuck in the conveying nip between the fixing section discharge rollers 24, and hence causing a paper jam, can automatically be taken out. This eliminates the need for a human to hold the paper in hand and pull it out, saving the trouble and time to do so, and permitting the paper P to be easily moved away from the hot fixing roller 21. Even if the paper P is wound around the fixing roller 21, it can be easily disposed of. Since the fixing section discharge rollers 24 can be moved into an open position, a wide space can be secured on the downstream side of the fixing section 20. This makes jam disposal easy. In this way, it is possible to construct the exit part of the fixing section 20 compactly, and simultaneously to make easy and safe jam disposal possible without interference by other members, specifically the fixing section discharge rollers 24, disposed on the downstream side of the fixing and pressing rollers 21 and 22.

The separating mechanism 50 is further provided to release the fixing nip formed as a result of the fixing and pressing rollers 21 and 22 being brought into pressed contact with each other. In a coordinated manner as the openable section 40 is opened, the separating mechanism 50 brings the fixing and pressing rollers 21 and 22 apart from each other. Thus, when a paper jam occurs with the paper P stuck in the fixing nip, the nip can be released so that the paper can be taken out easily. Thus, when a paper jam occurs in the fixing section 20, jam disposal can be performed more easily and safely.

The separating mechanism 50 is built as a cam mechanism that brings the fixing and pressing rollers 21 and 22 apart from each other as the openable section 40 is opened. As the openable section 40 is rotated, the fixing and pressing rollers 21 and 22 can automatically be moved apart from each other. Thus, without the need for a complicate mechanism or electrical circuitry, and hence with a compact, simple construction, it is possible to facilitate jam disposal in the fixing section 20.

The axis of rotation of the cam portion 51 included in the cam mechanism is aligned with the axis of the pressing roller 22. This helps reduce the space occupied by the cam portion 51 and thereby achieve space saving in the openable section 40. This reduces restrictions in design, and permits the part around the fixing section 20 to be made more compact. Moreover, with the resulting simpler mechanism, it is possible to move the fixing and pressing rollers 21 and 22 apart from each other with a weak force.

The openable section 40 has a double-side-copying paper conveying passage 13 formed on the face thereof facing away from the inner wall portion 43, that is, facing away from the face where the fixing section 20 is provided. Thus, in an image forming apparatus capable of double-side printing, there is no need to provide an extra member to form the double-side-copying paper conveying passage 13. This helps reduce the number of components, and helps achieve space saving and cost reduction.

The openable section 40 has a pair of conveying rollers 32 as paper conveying rollers provided on the downstream side of the fixing section discharge rollers 24 with respect to the paper conveying direction. As the openable section 40 is opened, the conveying rollers 32 can be moved into an open position. Thus, if the paper P is stuck in the conveying nip between the paper conveying rollers 32, it can automatically be taken out. Thus, even when a paper jam occurs further downstream of the fixing section discharge rollers 24, it is possible to dispose of the paper jam easily and safely without taking trouble and time.

The present invention may be carried out in any manner other than specifically described above as an embodiment. For example, in the fixing section discharge rollers 24, instead of the drive roller 24*a* and the driven roller 24*b* being arranged on the right and left, respectively, of the paper conveying passage as shown in FIG. 2, they may be arranged the other way around. Likewise, in the conveying rollers 32, instead of the drive roller 32*a* and the driven roller 32*b* being arranged above and below, respectively, the paper conveying passage, they may be arranged the other way around. Instead of the openable section 40 being given the same dimension as the pressing roller 22 in the paper width direction, it may be formed shorter or longer than the pressing roller 22 in that direction.

It should be understood that the embodiment specifically described above is not meant to limit the scope of the present invention in any way, and that many modifications and variations are possible within the spirit of the present invention when it is practiced.

The present invention is useful in image forming apparatuses in general.

What is claimed is:

1. An image forming apparatus comprising:

a fixing section including a fixing member and a pressing member each built as a rotary member;

a pair of fixing section discharge rollers, disposed on a downstream side of the fixing section with respect to a paper conveying direction, for discharging paper out of the fixing section and further downstreaim;

an openable section having the pair of fixing section discharge rollers mounted thereon, the openable section being rotatable about a pivot portion thereof parallel to an axis of the fixing or pressing member so as to make externally accessible a paper conveying passage on the downstream side of the fixing section with respect to the paper conveying direction; and a separating mechanism for releasing a fixing nip formed as a result of the fixing and pressing members being brought into pressed contact with each other, the separating mechanism bringing the fixing and pressing members apart from each other in a coordinated manner as the openable section is opened, wherein the separating mechanism includes a cam having an axis of rotation aligned with the axis of the pressing member.

2. The image forming apparatus of claim 1, wherein the openable section has a double-side-copying paper conveying passage formed on a face thereof facing away from the fixing section.

3. The image forming apparatus of claim 1, wherein the openable section has a pair of paper conveying rollers disposed on a downstream side of the fixing section discharge rollers with respect to the paper conveying direction.

4. The image forming apparatus of claim 2, wherein the openable section has a pair of paper conveying rollers disposed on a downstream side of the fixing section discharge rollers with respect to the paper conveying direction.

5. An image forming apparatus comprising:

a fixing section including a fixing member and a pressing member each built as a rotary member;

an openable section rotatable about a pivot portion thereof parallel to an axis of the fixing or pressing member so as to make externally accessible a paper conveying passage on the downstream side of the fixing section with respect to a paper conveying direction; and a separating mechanism for releasing a fixing nip formed as a result of the fixing and pressing members being brought into pressed contact with each other, the separating mechanism bringing the fixing and pressing members apart from each other in a coordinated manner as the openable section is opened, wherein the separating mechanism includes a cam having an axis of rotation aligned with the axis of the pressing member.

* * * * *